US008263894B2

(12) United States Patent
Tak et al.

(10) Patent No.: US 8,263,894 B2
(45) Date of Patent: Sep. 11, 2012

(54) ELECTRODE FOR VACUUM INTERRUPTER

(75) Inventors: Sung Jun Tak, Chungcheongbuk-Do (KR); Jae Seop Ryu, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 292 days.

(21) Appl. No.: 12/651,501

(22) Filed: Jan. 4, 2010

(65) Prior Publication Data

US 2010/0230388 A1 Sep. 16, 2010

(30) Foreign Application Priority Data

Mar. 11, 2009 (KR) ..... 10-2009-0020899

(51) Int. Cl.
*H01H 33/66* (2006.01)

(52) U.S. Cl. ..... 218/123; 218/129

(58) Field of Classification Search ..... 218/118–129, 218/10, 16, 17, 141, 146
See application file for complete search history.

(56) References Cited

U.S. PATENT DOCUMENTS

| | | | | |
|---|---|---|---|---|
| 5,438,174 | A * | 8/1995 | Slade | 218/118 |
| 5,597,993 | A * | 1/1997 | Yorita et al. | 218/129 |
| 6,163,002 | A * | 12/2000 | Ahn et al. | 218/123 |
| 6,506,992 | B2 * | 1/2003 | Kim | 218/123 |
| 6,787,725 | B2 | 9/2004 | Kim et al. | |
| 6,884,949 | B2 | 4/2005 | Yoon | |
| 7,227,279 | B2 | 6/2007 | Kim | |
| 2002/0043514 | A1 | 4/2002 | Kim, II | |

FOREIGN PATENT DOCUMENTS

| | | |
|---|---|---|
| CN | 1206685 | 6/2005 |
| JP | 56-5340 | 1/1981 |
| JP | 1-164637 | 11/1989 |
| JP | 5-190062 | 7/1993 |

OTHER PUBLICATIONS

U.S. Appl. No. 12/633,827 to Park, filed Dec. 9, 2009.

(Continued)

*Primary Examiner* — Amy Cohen Johnson
*Assistant Examiner* — Marina Fishman
(74) *Attorney, Agent, or Firm* — Greenblum & Bernstein P.L.C.

(57) ABSTRACT

Disclosed is an electrode for a vacuum interrupter, capable of reducing damage of contacts due to heat concentration to the center of the contacts, by reducing magnetic flux concentration to the center of the electrode, and capable of rapidly extinguishing an arc by diffusing the arc by forming a wide range of magnetic flux.

The electrode for a vacuum interrupter comprises: a contact electrode plate configured to provide contacts; an inner coil electrode formed of one electric conductor having an open loop shape, and through which a current flows in a first rotation direction; an outer coil electrode formed of one electric conductor having an open loop shape, concentrically arranged with the inner coil electrode at an outer side of the inner coil electrode in a radius direction, and through which a current flows in a second rotation direction opposite to the first rotation direction parallel to the current flowing to the inner coil electrode; a first conductive pin formed of a conductive material, and configured to provide an electric current path by connecting the contact electrode plate and the inner coil electrode with each other; and a second conductive pin formed of a conductive material, and configured to provide an electric current path by connecting the contact electrode plate and the outer coil electrode with each other.

16 Claims, 6 Drawing Sheets

OTHER PUBLICATIONS

U.S. Appl. No. 12/633,863 to Kim et al., filed Dec. 9, 2009.
U.S. Appl. No. 12/635,911 to Woo, filed Dec. 11, 2009.
U.S. Appl. No. 12/641,769 to Kim, filed Dec. 18, 2009.
U.S. Appl. No. 12/641,946 to Seo, filed Dec. 18, 2009.
U.S. Appl. No. 12/645,783 to Kim, filed Dec. 23, 2009.
U.S. Appl. No. 12/645,620 to Kim et al., filed Dec. 23, 2009.
Japan Office action, mail date is Feb. 7, 2012.
China Official Action, dated Jun. 15, 2012.

* cited by examiner

ELECTRODE FOR VACUUM INTERRUPTER

RELATED APPLICATION

The present disclosure relates to subject matter contained in priority Korean Application No. 10-2009-0020899, filed on Mar. 11, 2009, which is herein expressly incorporated by reference in its entirety.

BACKGROUND OF THE INVENTION

1. Field of the Invention

The present invention relates to a vacuum interrupter, and particularly, to an electrode for a vacuum interrupter.

2. Background of the Invention

A vacuum interrupter refers to a power system used as a main circuit switching mechanism for a circuit breaker of a high voltage corresponding to several kilo voltages, or a main circuit switching mechanism of a super high voltage corresponding to several tens or hundreds of voltages, due to a high electric insulation characteristic and an arc extinguishing function in a vacuum state.

A structure and an operation of a general vacuum interrupter will be explained with reference to FIG. 1.

A vacuum interrupter 100 comprises an insulating container 60 maintaining a vacuum state and formed of an electric insulating material such as ceramic; a fixed electrode 10 fixedly installed in the insulating container 60; and a movable electrode 40 configured to be movable to a closing position contacting the fixed electrode 10, or an opening position separated from the fixed electrode 10. The fixed electrode 10 is connected to a fixed rod 20 connected to a power source of an electric circuit. The fixed rod 20 has a part extending to inside of the insulating container 60 thus to be connected to the fixed electrode 10, and a part extending to outside of the insulating container 60 thus to be connected to the power side.

A movable electrode 40 is connected to a movable rod 30 connected to an electrical load of the electric circuit. The movable rod 30 has a part extending to inside of the insulating container 60 thus to be connected to the movable electrode 40, and a part extending to outside of the insulating container 60 thus to be connected to the load side.

At an inner center of the insulating container 60, installed is a central arc shield 70 for shielding an inner wall of the insulating container 60 from an arc generated when the movable electrode 40 is moved to an opening position separated from the fixed electrode 10.

Connection flanges 60*a* and 60*b* are welded to outer upper and lower parts of the insulating container 60, respectively, thereby maintaining the inside of the insulating container 60 as a hermetic state.

The connection flange 60*b* disposed at a lower part of the insulating container 60 is provided with a guide flange 90 for allowing the movable rod 30 to be movable in an axial direction.

A bellows 50 is connected to the lower connection flange 60*b* adjacent to the movable rod 30, so as to be expanded or contracted as the movable rod 30 moves. And, a bellows shielding member 80 for shielding the bellows 50 from an arc is installed so as to shield the end of the bellows 50, the end disposed at a side of the movable electrode 40.

In order to rapidly extinguish an arc generated between the movable electrode and the fixed electrode of the vacuum interrupter when the movable electrode moves to an open circuit position, has been proposed a structure to generate an axial magnetic flux (AMF).

However, in the conventional electrode, an axial magnetic flux (AMF) density is increased at the center of the electrode. This phenomenon causes an arc to be concentrated to the center of the electrode, resulting in high heat emission. As a result, the centers of the contacts in the movable electrode and the fixed electrode may be damaged.

Furthermore, since an arc is concentrated to the center of the electrode, it may take a long time to extinguish the arc.

SUMMARY OF THE INVENTION

Therefore, an object of the present invention is to provide an electrode for a vacuum interrupter capable of evenly distributing an axial magnetic flux (AMF) density without concentrating the AMF density on the center of the electrode.

To achieve these and other advantages and in accordance with the purpose of the present invention, as embodied and broadly described herein, there is provided an electrode for a vacuum interrupter, comprising: a contact electrode plate configured to provide contacts; an inner coil electrode formed of one electric conductor having an open loop shape, and through which a current flows in a first rotation direction; an outer coil electrode formed of one electric conductor having an open loop shape, concentrically arranged with the inner coil electrode at an outer side of the inner coil electrode in a radius direction, and through which a current flows in a second rotation direction opposite to the first rotation direction parallel to the current flowing to the inner coil electrode; a first conductive pin made of a conductive material, and configured to provide an electric current path by connecting the contact electrode plate and the inner coil electrode with each other; and a second conductive pin made of a conductive material, and configured to provide an electric current path by connecting the contact electrode plate and the outer coil electrode with each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

The electrode for a vacuum interrupter according to the present invention will be explained in more detail with reference to the attached drawings.

Firstly, the present invention will be explained with reference to FIGS. 2, 3, 7 and 8.

Figure 1:
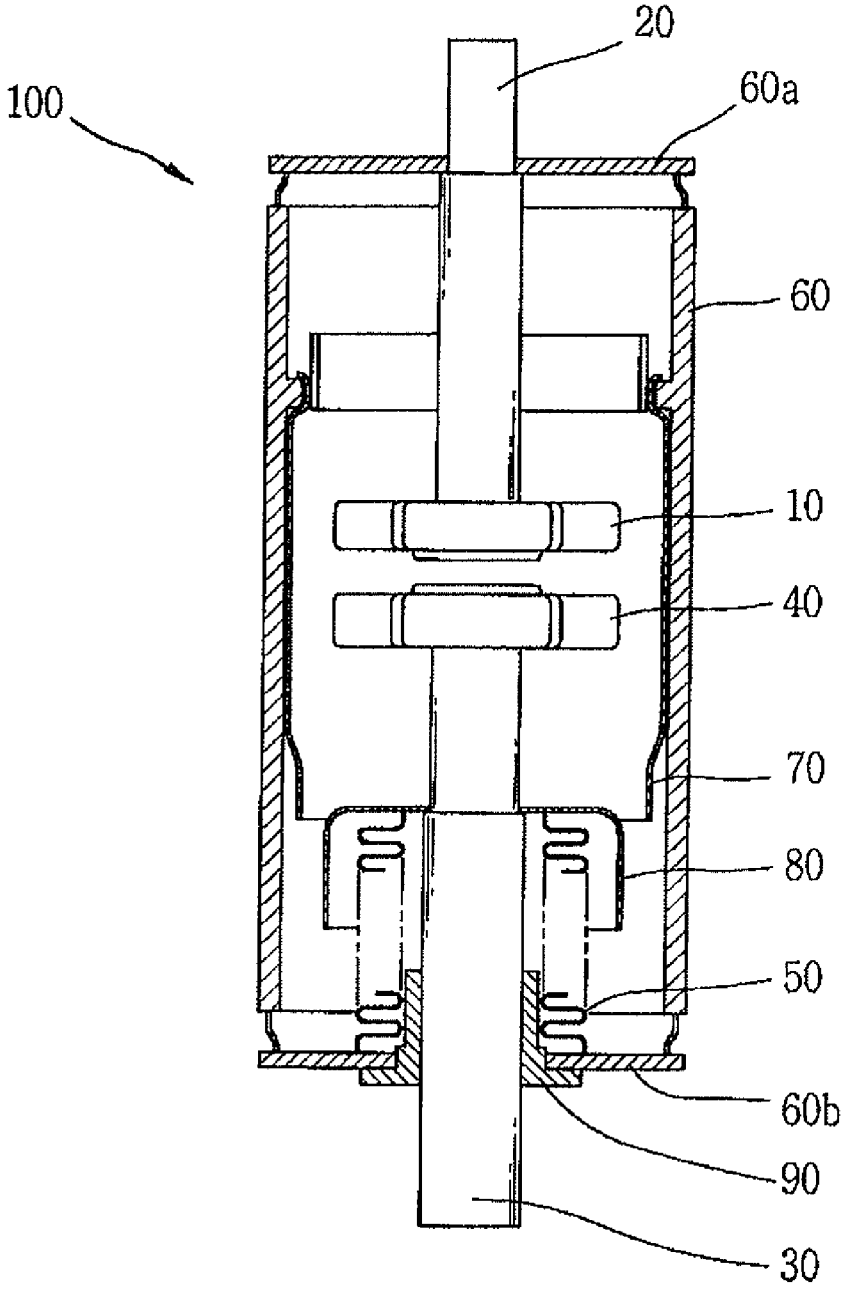
FIG. 1 is a sectional view showing a structure of a vacuum interrupter in accordance with the conventional art.
Figure 2:
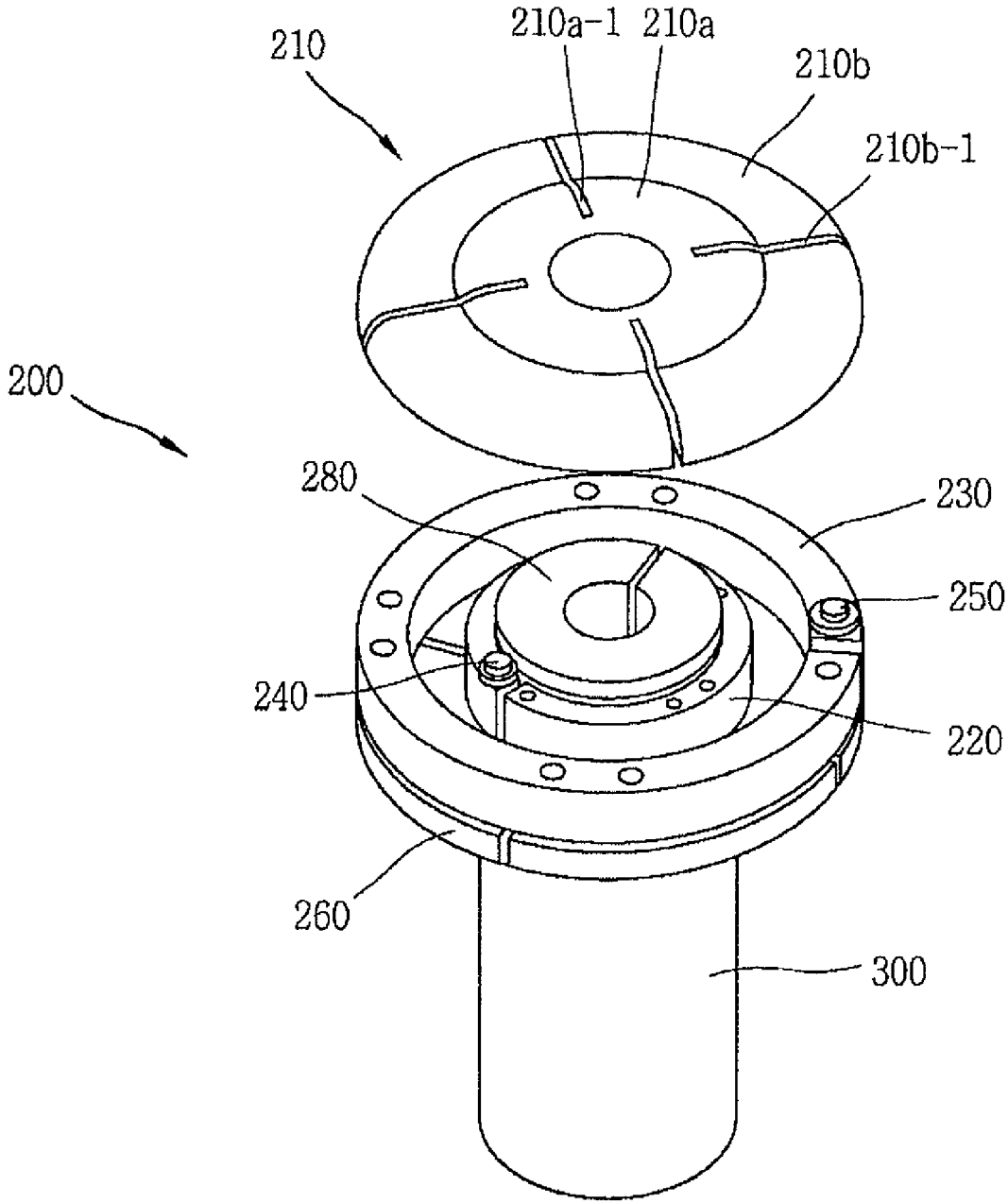
FIG. 2 is a perspective view of an electrode for a vacuum interrupter according to the present invention, which shows a disassembled state of a contact electrode plate.
Figure 3:
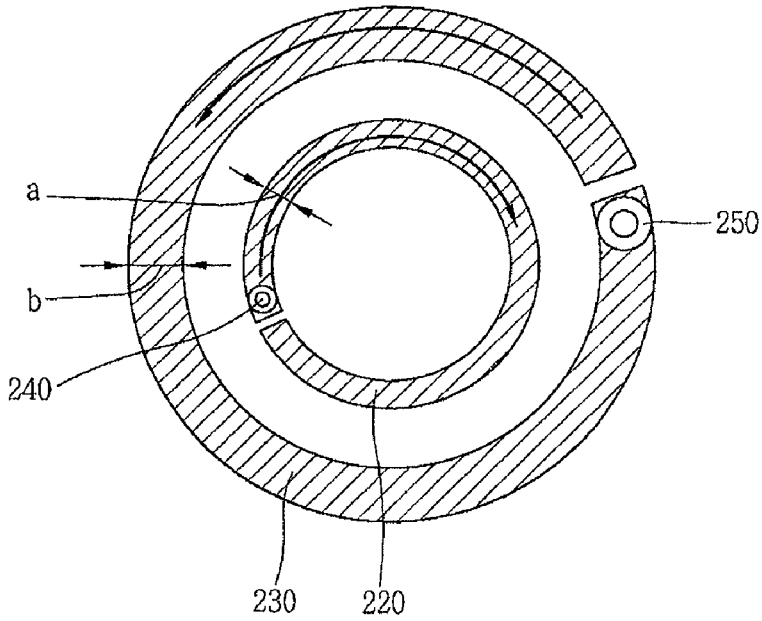
FIG. 3 is a horizontal sectional view showing directions of currents respectively flowing through inner and outer coil electrodes of the electrode for a vacuum interrupter according to a first embodiment of the present invention.
Figure 7:
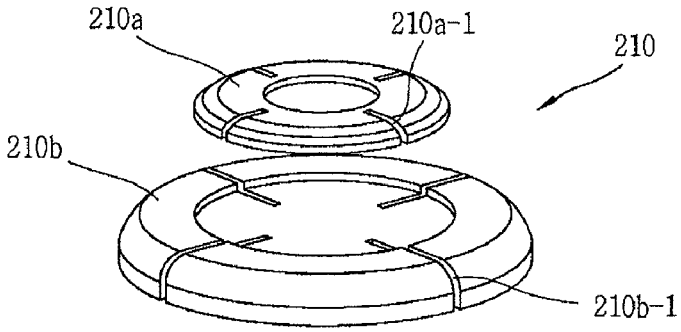
FIG. 7 is a disassembled perspective view showing a configuration of a contact electrode plate of the electrode for a vacuum interrupter according to the present invention.
Figure 8:
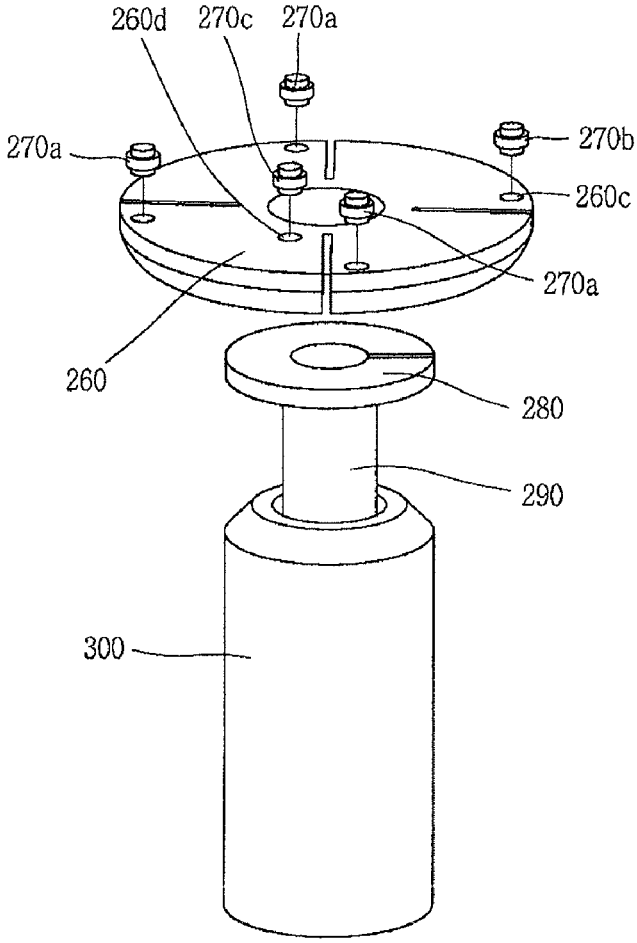
FIG. 8 is a disassembled perspective view showing each configuration of a supporting plate, a conductor supporting rod, and a movable rod of the electrode for a vacuum interrupter according to the present invention.

FIG. 2 is a perspective view of an electrode for a vacuum interrupter according to the present invention, which shows a disassembled state of a contact electrode plate, FIG. 3 is a horizontal sectional view showing directions of currents respectively flowing through inner and outer coil electrodes of the electrode for a vacuum interrupter according to a first embodiment of the present invention, FIG. 7 is a disassembled perspective view showing a configuration of a contact electrode plate of the electrode for a vacuum interrupter according to the present invention, and FIG. 8 is a disassembled perspective view showing each configuration of a supporting plate, a conductor supporting axis, and a movable axis of the electrode for a vacuum interrupter according to the present invention.

An electrode 200 for a vacuum interrupter according to a first embodiment of the present invention refers to a movable electrode or a fixed electrode of a general vacuum interrupter aforementioned in the background of the invention.

The electrode 200 comprises a contact electrode plate 210, an inner coil electrode 220, an outer coil electrode 230, a first conductive pin 240, and a second conductive pin 250.

The contact electrode plate 210 provides contacts between a movable electrode and fixed electrode, the contacts for allowing an electric connection or disconnection therebetween by mechanically contacting each other or by being separated from each other. Slits 210*a* of the contact electrode plate 210 for preventing the occurrence of eddy currents is formed in four in number. As shown in FIG. 7, the contact electrode plate 210 includes a main contact electrode plate 210*a*, and a supplementary contact electrode plate 210*b*.

In order to prevent the occurrence of eddy currents, the main contact electrode plate 210*a* and the supplementary contact electrode plate 210*b* are provided with a plurality of slits 210*a*-1, 210*b*-1 in a radius direction, respectively. Referring to FIG. 7, the supplementary contact electrode plate 210*b* is provided with a concaved portion at an upper central part thereof, so that the main contact electrode plate 210*a* can be forcibly inserted into the concaved portion to undergo a brazing process. Although not shown, on a lower surface of the supplementary contact electrode plate 210*b*, disposed are conductive pin insertion groove portions for inserting the first and second conductive pins 240, 250 that will be later explained. Here, the conductive pin insertion groove portions are disposed in a radius direction at positions corresponding to the conductive pin insertion groove portions of the inner and outer coil electrodes 220, 230 that will be later explained.

The inner coil electrode 220 is formed of one electric conductor having an open loop shape. A current may flow through the inner coil electrode 220 in a first rotation direction. Here, the open loop shape indicates that the inner coil electrode 220 of FIG. 2 implemented as a ring shape electric conductor having a predetermined width has an open channel part between two left ends thereof by being partially cut.

The outer coil electrode 230 is formed of one electric conductor having an open loop shape, and is concentrically arranged with the inner coil electrode 220 at an outer side of the inner coil electrode 220 in a radius direction. Like the inner coil electrode 220, the outer coil electrode 230 is implemented as a ring-shaped electric conductor having a predetermined width. However, as some parts of the outer coil electrode 230 are cut, the outer coil electrode 230 is provided with an open channel part between two right ends thereof. A current flows through the outer coil electrode 230 in a direction opposite to that of a current flowing through the inner coil electrode 220, and flows parallel to the current flowing through the inner coil electrode 220. The parallel flowing means that in the case of the fixed electrode, an electric current from a power source simultaneously and dividedly flows to the inner and outer coil electrodes 220, 230, through a main rod 300, a supplementary electrode plate 260, a third conductive pin 270*b*, and a fourth conductive pin 270*c*. And, in the case of the movable electrode, parallel flowing means that a current from the contact electrode plate 210 simultaneously and dividedly flows to the inner and outer coil electrodes 220, 230 through the first and second conductive pins 240, 250. Referring to FIGS. 2 and 3, the first rotation direction indicates a clockwise direction, whereas the second rotation direction indicates a counterclockwise direction.

Referring to FIG. 3, a current path of the outer coil electrode 230 has a width (b) wider than a width (a) of a current path of the inner coil electrode 220. The first conductive pin 240 is implemented in one in number, and is formed of a conductor such as copper. And, the first conductive pin 240 provides a current path by connecting the contact electrode plate 210 and the inner coil electrode 220 to each other. The first conductive pin 240 is implemented as a conductor pin comprises a cylindrical flange portion having a predetermined thickness, and upper and lower protrusions upwardly and downwardly extending from the cylindrical flange portion.

The second conductive pin 250 is implemented in one in number, and is made of a conductor such as copper. And, the second conductive pin 250 provides a current path by connecting the contact electrode plate 210 and the outer coil electrode 230 to each other. Like the first conductive pin 240, the second conductive pin 250 is implemented as a conductor pin comprises a cylindrical flange portion having a predetermined thickness, and upper and lower protrusions upwardly and downwardly extending from the cylindrical flange portion.

As shown in FIGS. 2 and 3, in order to make directions of currents flowing through the inner and outer coil electrodes 220, 230 opposite to each other, the first conductive pin 240 is positioned on a rotated position from the second conductive pin 250 by an angle of 180°~270° in a clockwise direction or a counterclockwise direction (about 210° in a counterclockwise direction in FIGS. 2 and 3).

Referring to FIG. 2, a supporting plate 280 disposed at a nearer position of center than the radial position of the inner coil electrode 220 supports the contact electrode plate 210 by contacting a lower surface of the contact electrode plate 210. The supporting plate 280 may be made of a material having a mechanical strength and an electric resistance larger than those of the conductive pins, or having an insulation characteristic. The contact electrode plate 210 and the supporting plate 280 may be connected to each other by a brazing method.

Figure 9:
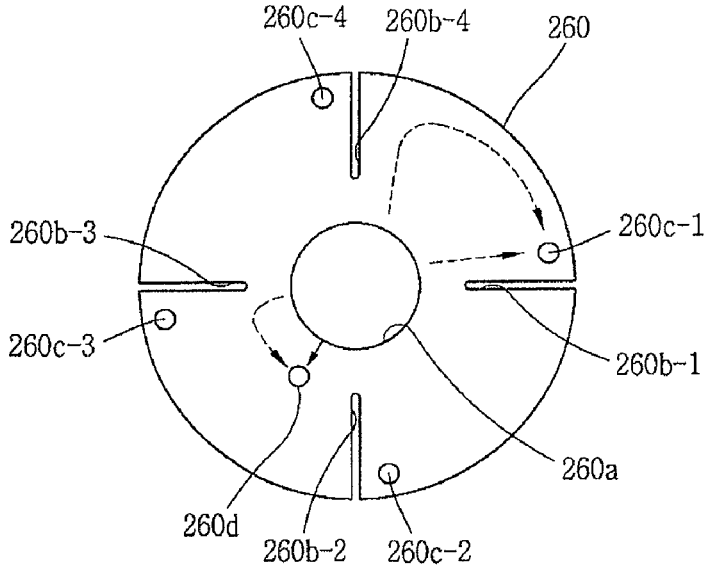
FIG. 9 is a planar view showing a detailed structure and an operation of a supplementary electrode plate according to a first embodiment, in the electrode for a vacuum interrupter according to the present invention.

Referring to FIGS. 2 and 8~10, the electrode 200 for a vacuum interrupter according to the present invention may further comprise a supplementary electrode plate 260, a third conductive pin 270*b* and a fourth conductive pin 270*c*. The supplementary electrode plate 260 is made of a conductor, and is installed below the inner and outer coil electrodes 220, 230. As shown in FIGS. 8 and 9, the supplementary electrode plate 260 according to the first embodiment includes first to fourth slits 260*b*-1, 260*b*-2, 260*b*-3, 260*b*-4 formed in a radius direction toward its center from its outer circumferential surface, so as to additionally form an axial magnetic flux at the inner and outer coil electrodes, and to prevent the occurrence of eddy currents. Here, the four slits 260*b*-1, 260*b*-2, 260*b*-3, 260*b*-4 are disposed with an interval of 90° therebetween.

As shown in FIG. 9, the supplementary electrode plate 260 is provided with a through hole 260*a* at the center thereof. And, an inner circumferential surface of the supplementary electrode plate 260 having the through hole 260*a* comes in contact with a conductor supporting rod 290 of FIG. 8. Accordingly, an electric current may flow to the supplementary electrode plate 260 from the conductor supporting rod 290, or to the conductor supporting rod 290 from the supplementary electrode plate 260. The conductor supporting rod 290 is installed to be extending via the through hole 260*a* of the supplementary electrode plate 260. And, the conductor supporting rod 290 and the supplementary electrode plate 260 are connected to each other by a brazing method, or their positions relative to each other are fixed by a brazing method.

As shown in FIG. 9, the supplementary electrode plate 260 according to the first embodiment is provided with first to fourth pin insertion grooves 260*c*-1, 260*c*-2, 260*c*-3, 260*c*-4 for inserting the third conductive pin 270*b* or supporting pins 270*a* that will be later explained. Each of the first to fourth pin insertion grooves 260*c*-1, 260*c*-2, 260*c*-3, 260*c*-4 is formed in at least one in number. And, the first to fourth pin insertion grooves 260*c*-1, 260*c*-2, 260*c*-3, 260*c*-4 are disposed at four parts divided from one another by one pair of adjacent slits among the first to fourth slits 260*b*-1, 260*b*-2, 260*b*-3, 260*b*-4, and adjacent to an outer circumferential surface of the supplementary electrode plate 260.

As shown in FIGS. 8 and 9, a pin insertion groove 260*d* for inserting the fourth conducive pin 270*c* to be connected to the inner coil electrode 220 is disposed at one part adjacent to the through hole 260*a* of the supplementary electrode plate 260. Referring to FIG. 9, a current from an inner circumferential surface of the supplementary electrode plate 260 flows to conductive pin connecting grooves 260*c*-1, 260*d* for inserting the third conductive pin 270*b* and the fourth conductive pin 270*c*, among the four parts divided from one another by one pair of slits among the first to fourth slits 260*b*-1, 260*b*-2, 260*b*-3, 260*b*-4, along the arrow direction. Accordingly, each current loop is formed. Current applied on the loops flow in the same direction as the currents flowing through the inner and outer coil electrodes 220, 230 connected to the third and fourth conductive pins 270*b*, 270*c*. Accordingly, formed is a magnetic flux having the same direction as the magnetic flux formed by the inner and outer coil electrodes 220, 230. This axial magnetic flux attracts an arc at the time of an opening operation to break an electric circuit by separating the movable electrode from the fixed electrode, and then diffuses the arc in a horizontal direction for rapid extinguishment.

Referring to FIG. 8, the three supporting pins 270*a* is installed between the supplementary electrode plate 260 and the outer coil electrode 230. However, although not shown, the three supporting pins 270*a* may be installed between the contact electrode plate 210 and the outer coil electrode 230, and between the contact electrode plate 210 and the inner coil electrode 220. The supporting pins 270*a* have a similar shape to the conductive pins, but are made of a material having an electric resistance larger than each resistance of the inner and outer coil electrodes and the conductive pins. Accordingly, the supporting pins do not provide a current path, but supplement a mechanical strength of the electrode. Preferably, the supporting pins 270*a* can be made of stainless steel.

The two conductive pins of FIG. 8, i.e., the third conductive pin 270*b* and the fourth conductive pin 270*c* are made of electric conductors. And, the third conductive pin 270*b* and the fourth conductive pin 270*c* are connected between the supplementary electrode plate 260 and the outer coil electrode 230, and between the supplementary electrode plate 260 and the inner coil electrode 220, thereby providing each current path therebetween.

As shown in FIGS. 8 and 9, in order to make directions of currents flowing through the inner and outer coil electrodes 220, 230 opposite to each other, the fourth conductive pin 270*c* is rotated from the third conductive pin 270*b* by an angle of 180°~270° in a clockwise direction or a counterclockwise direction (about 210° in a counterclockwise direction in FIGS. 8 and 9).

The third conductive pin 270*b* is disposed at an outer side of the electrode (position far from the center of the electrode) in correspondence to a position of the outer coil electrode 230 to be connected thereto in a radius direction. The fourth conductive pin 270*c* is disposed at an inner side of the electrode (position close to the center of the electrode) in correspondence to a position of the inner coil electrode 220 to be connected thereto in a radius direction.

Figure 10:
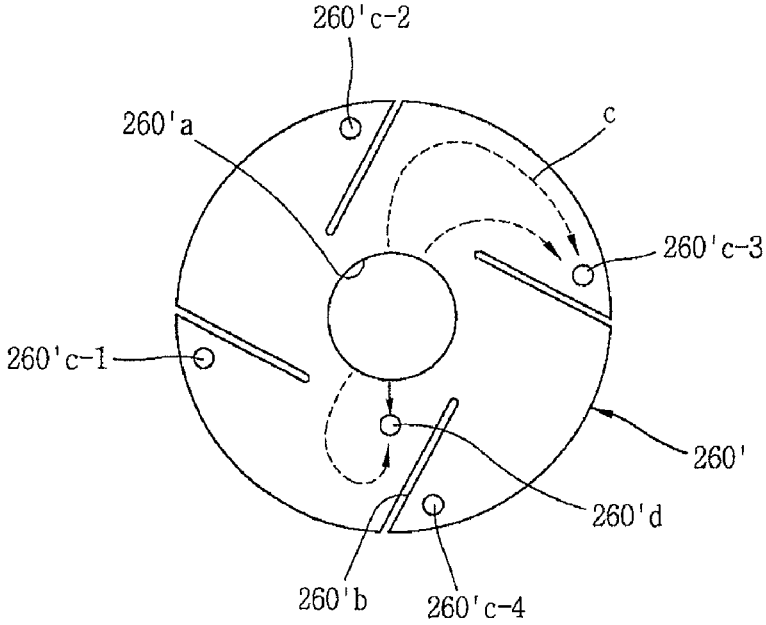
FIG. 10 is a planar view showing a detailed structure and an operation of a supplementary electrode plate according to a second embodiment, in the electrode for a vacuum interrupter according to the present invention.

Hereinafter, will be explained a structure and an operation of a supplementary electrode plate 260' according to a second embodiment with reference to FIG. 10.

The supplementary electrode plate 260' according to the second embodiment is a supplementary means of the inner and outer coil electrodes. And, the supplementary electrode plate 260' includes a plurality of slits 260'*b* slantly formed by an acute angle in a radius direction, so as to form an axial magnetic flux and to prevent the occurrence of an eddy current. Preferably, the inclination angle of the slits 260'*b* in the radius direction is in the range of 30°~40°. As the slits 260'*b* are slantly formed in a radius direction, a current path (C) having a circular arc shape is formed, thereby forming an axial magnetic field (AMF). Accordingly, an occurred arc is attracted to be distributed, thereby being rapidly extinguished. Furthermore, the occurrence of eddy currents can be more effectively prevented.

Hereinafter, will be explained a configuration and an operation of an electrode for a vacuum interrupter according to the second embodiment with reference to FIG. 6.

The electrode for a vacuum interrupter according to the second embodiment has the same configuration and effects as the electrode for a vacuum interrupter according to the first embodiment, except that the inner and outer coil electrodes are formed in two in number, respectively. Accordingly, with reference to FIG. 6, will be explained only the differences between the electrode according to the second embodiment and the electrode according to the first embodiment.

Figure 6:
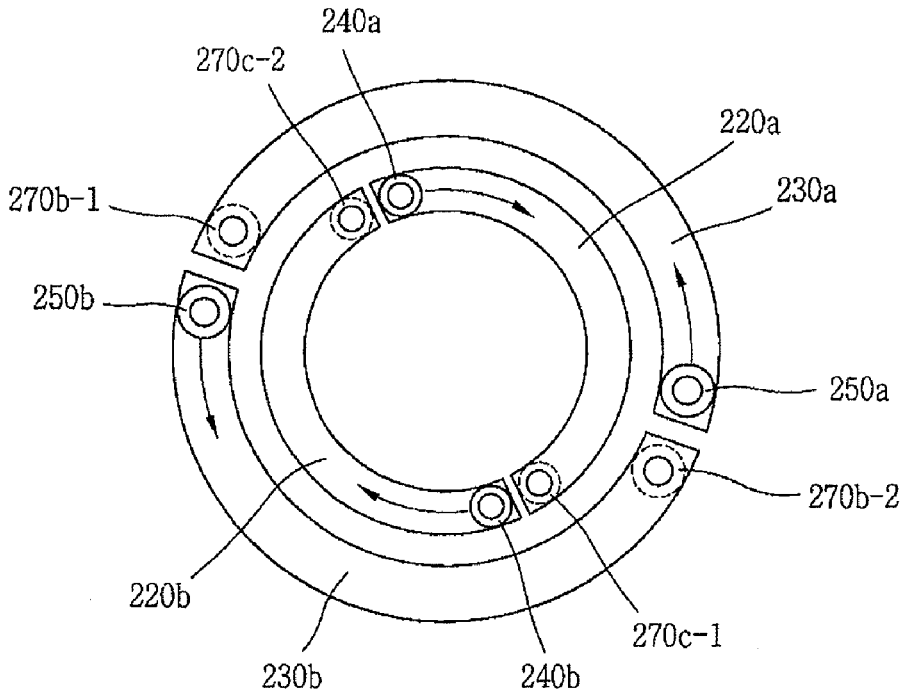
FIG. 6 is a horizontal sectional view showing directions of currents respectively flowing through inner and outer coil electrodes of an electrode for a vacuum interrupter according to a second embodiment of the present invention.

As shown in FIG. 6, the electrode for a vacuum interrupter according to the second embodiment comprises an inner coil electrode 220 comprises two electric conductors, i.e., a first inner coil electrode 220*a* and a second inner coil electrode 220*b*, and an outer coil electrode 230 comprises two electric conductors, i.e., a first outer coil electrode 230*a* and a second outer coil electrode 230*b*.

A current may flow in a first rotation direction through the first and second inner coil electrodes 220*a*, two electric conductors having an open loop shape. Referring to FIG. 6, once a current is applied to the first and second inner coil electrodes 220*a*, 220*b*, from the contact electrode plate (not shown, refer to 210 in FIG. 2), through the first conductive pins 240*a*, 240*b*, the current flows on the first and second inner coil electrodes 220*a*, 220*b* in a clockwise direction. On the contrary, once a current is applied to the first and second inner coil electrodes 220*a*, 220*b*, from the supplementary electrode plate (not shown, 260 or 260'), through the fourth conductive pins 270*c*-1, 270*c*-2, the current flows on the first and second inner coil electrodes 220*a*, 220*b* in a counterclockwise direction.

The first outer coil electrode 230*a* and the second outer coil electrode 230*b* are disposed at an outer side of the first and second inner coil electrodes 220*a*, 220*b* in a radius direction, and are made of two electric conductors having an open loop shape and concentrically arranged with the first and second coil electrodes 220*a*, 220*b*. In parallel to the current flowing to the first and second inner coil electrodes 220*a*, 220*b* through the first and second outer coil electrodes 230*a*, 230*b*, a current flows in a second rotation direction opposite to the first rotation direction. This is because the first conductive pins 240*a*, 240*b* serving as starting points of the current that flows through the first and second inner coil electrodes 220*a*, 220*b* are rotated, from the second conductive pins 250*a*, 250*b* serving as starting points of the current that flows through the first and second outer coil electrodes 230*a*, 230*b*, by an angle of 180°~270° (about 210°) in a clockwise direction. Also, this is because the fourth conductive pins 270*c*-1, 270*c*-2 serving as starting points of the current that flows through the first and second inner coil electrodes 220*a*, 220*b* are rotated, from the third conductive pins 270*b*-1, 270*b*-2 serving as starting points of the current that flows through the first and second outer coil electrodes 230*a*, 230*b*, by an angle of 180°~270° (about 210°) in a clockwise direction.

Referring to FIG. 6, once a current is applied to the first and second outer coil electrodes 230*a*, 230*b*, from the contact electrode plate (not shown, refer to 210 in FIG. 2), through the second conductive pins 250*a*, 250*b*, the current flows on the first and second outer coil electrodes 230*a*, 230*b* in a counterclockwise direction. On the contrary, once a current is applied to the first and second outer coil electrodes 230*a*, 230*b*, from the supplementary electrode plate (not shown, 260 or 260'), through the third conductive pins 270*b*-1, 270*b*-2, the current flows on the first and second outer coil electrodes 230*a*, 230*b* in a clockwise direction.

Preferably, a path of a current flowing through the first and second outer coil electrodes 230*a*, 230*b* has a width wider than that of a current flowing through the first and second inner coil electrodes 220*a*, 220*b*. The reason is in order to make an electric resistance of the first and second inner coil electrodes 220*a*, 220*b* higher than that of the first and second outer coil electrodes 230*a*, 230*b*, and thereby to make the amount of the current flowing through the first and second outer coil electrodes 230*a*, 230*b* greater than that of the current flowing through the first and second inner coil electrodes 220*a*, 220*b*. Accordingly, an axial magnetic flux occurring around the first and second outer coil electrodes 230*a*, 230*b* is greater than that occurring around the first and second inner coil electrodes 220*a*, 220*b*. As a result, an arc can be intensively attracted to the first and second outer coil electrodes 230*a*, 230*b*.

Like the electrode for a vacuum interrupter according to the first embodiment, the electrode for a vacuum interrupter according to the second embodiment comprises a contact electrode plate (refer to 210 in FIG. 2) that provides contacts. Also, the electrode for a vacuum interrupter according to the second embodiment may further comprise a supplementary electrode plate (refer to 260; 260' in FIGS. 8 to 10) installed below the inner coil electrodes 220*a*, 220*b* and the outer coil electrodes 230*a*, 230*b*, made of and electric conductor, and having a plurality of slits formed in a radius direction so as to form an axial magnetic flux and to prevent the occurrence of eddy currents. Furthermore, the electrode for a vacuum interrupter according to the second embodiment may further comprise a plurality of third conductive pins 270*b*-1, 270*b*-2 installed between the outer coil electrode and the supplementary electrode plate for electric connection therebetween, and a plurality of fourth conductive pins 270*c*-1, 270*c*-2 installed between the inner coil electrode and the supplementary electrode plate for electric connection therebetween.

Hereinafter, the operation and effects of the electrode for a vacuum interrupter according to the first embodiment will be explained with reference to FIGS. 2 to 6.

Referring to FIG. 2, when a current flows to the main rod 300 from the contact electrode plate 210 of the movable electrode of the electrode 200 for a vacuum interrupter, the current flowing into the contact electrode plate 210 when being contacted, from the relative contact electrode plate (not shown) of the fixed electrode having a symmetrical structure flows to the inner coil electrode 220 through the first conductive pin 240 connected between the contact electrode plate 210 and the inner coil electrode 220. At the same time, the current flows to the outer coil electrode 230 through the second conductive pin 250 connected between the contact electrode plate 210 and the outer coil electrode 230.

The first conductive pin 240 is rotated from the second conductive pin 250 by an angle of 180°~270° in a clockwise direction or a counterclockwise direction (about 210° in a counterclockwise direction in FIGS. 2 and 3). Accordingly, a current applied to the outer coil electrode 230 flows in an opposite direction to a current applied to the inner coil electrode 220.

Referring to FIG. 2, when a current flows to the contact electrode plate 210 from the main rod 300 of the fixed electrode of the electrode 200 for a vacuum interrupter, the current flows to the inner coil electrode 220 via the third and fourth conductive pins 270*b*, 270*c* of FIG. 8, through the main rod 300 and the supplementary electrode plate 260, from a power source (not shown) having a symmetric structure. At the same time, the current flows to the outer coil electrode 230 in parallel.

The fourth conductive pin 270*c* is rotated from the third conductive pin 270*b* by an angle of 180°~270° in a clockwise direction or a counterclockwise direction (about 210° in a counterclockwise direction in FIG. 8). Accordingly, a current applied to the outer coil electrode 230 flows in an opposite direction to a current applied to the inner coil electrode 220.

Figure 4:
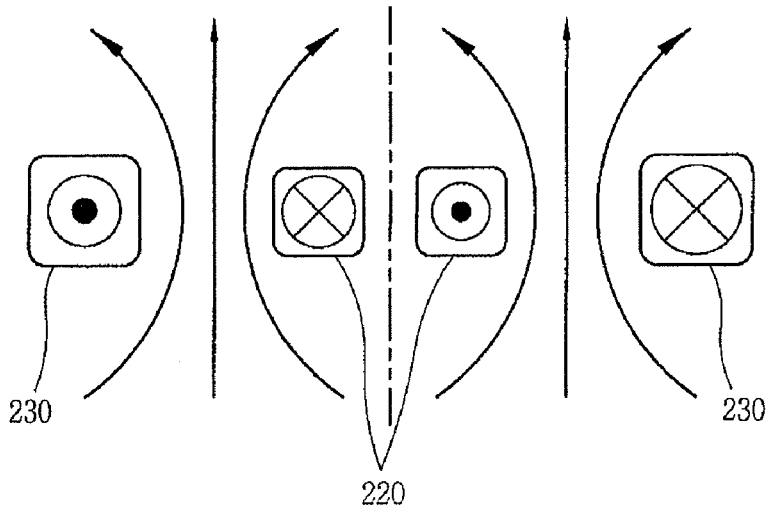
FIG. 4 is a view showing a magnetic flux forming process, in which magnetic fluxes having opposite directions eliminates each other partially at the center of the inner and outer coil electrodes of the electrode for a vacuum interrupter, but magnetic fluxes having the same direction are added to each other at a space between the inner and outer coil electrodes.

Referring to FIG. 4, a current flowing through the inner coil electrode 220 flows into the left side and flows out through the right side. However, a current flowing through the outer coil electrode 230 flows into the right side and flows out through the left side. Under these configurations, a magnetic flux due to the inner coil electrode 220, as shown in the center line of the electrode indicated by two dotted line, occurs at the center of the electrode from an upper side to a lower side. However, a magnetic flux due to the outer coil electrode 230 occurs at the center of the electrode from a lower side to an upper side. As a result, the magnetic flux due to the inner coil electrode 220 and the magnetic flux due to the outer coil electrode 230 eliminates each other at least partially to be weakened.

A magnetic flux occurring at a space between the inner and outer coil electrodes 220, 230 includes a magnetic flux occurring from a lower side to an upper side due to the external coil electrode 230, and a magnetic flux occurring from a lower side to an upper side due to the inner coil electrode 220. Accordingly, the magnetic fluxes are added to each other, thereby being implemented as a strong magnetic flux applied from a lower side to an upper side as indicated by the arrows of FIG. 4. As can be seen from FIG. 4, a strong axial magnetic flux occurs at an outer side (periphery) of the electrode in a radius direction.

Figure 5:
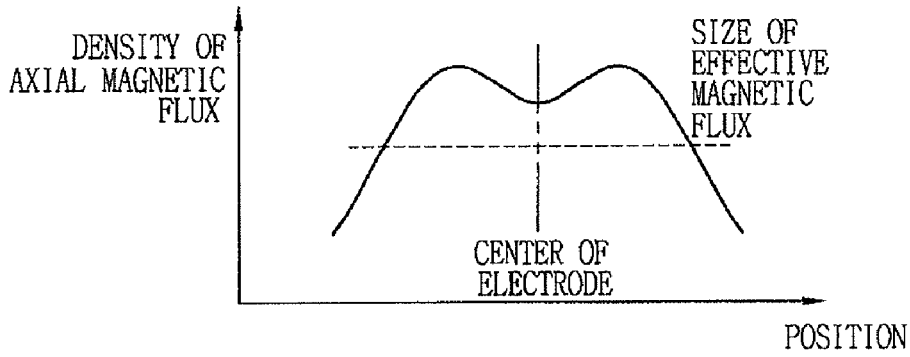
FIG. 5 is a graph showing a correlation between a position of the electrode for a vacuum interrupter in a radius direction (central position and position distant from the central position) and an axial magnetic flux (AMF) density.

FIG. 5 is a graph showing a correlation between a position of the electrode for a vacuum interrupter in a radius direction (center position and position distant from the center position) and an axial magnetic flux (AMF) density. As can be seen from FIG. 5, the AMF of the electrode for a vacuum interrupter, which is effective enough to attract an arc has a higher density at the periphery of the electrode than at the center of the electrode in a radius direction.

In the electrode for a vacuum interrupter according to the first embodiment of the present invention, a strong AMF occurs at the periphery spacing from the center in a radius direction, thereby attracting an arc generated when separating the movable electrode from the fixed electrode. This enables the arc to be distributed. Accordingly, can be solved the conventional problems such as delay of the arc extinguishing time, a lowered function, and damage of the contacts due to concentration of the arc to the center of the electrode.

The electrode for a vacuum interrupter according to the second embodiment is operated in the same manner as the electrode for a vacuum interrupter according to the first embodiment.

More concretely, a direction of a current flowing through the first and second outer coil electrodes 230*a*, 230*b* is a second rotation direction opposite to a first rotation direction of a current flowing through the first and second inner coil electrodes 220*a*, 220*b*. This is because the first conductive pins 240*a*, 240*b* serving as starting points of the current that flows through the first and second inner coil electrodes 220*a*, 220*b* are rotated, from the second conductive pins 250*a*, 250*b* serving as starting points of the current that flows through the first and second outer coil electrodes 230*a*, 230*b*, by an angle of 180°~270° (about 210°) in a clockwise direction. Also, this is because the fourth conductive pins 270*c*-1, 270*c*-2 serving as starting points of the current that flows through the first and second inner coil electrodes 220*a*, 220*b* are rotated, from the third conductive pins 270*b*-1, 270*b*-2 serving as starting points of the current that flows through the first and second outer coil electrodes 230*a*, 230*b*, by an angle of 180°~270° (about 210° in a clockwise direction.

Referring to FIG. 6, once a current is applied to the first and second outer coil electrodes 230*a*, 230*b*, from the contact electrode plate (not shown, refer to 210 in FIG. 2), through the second conductive pins 250*a*, 250*b*, the current flows on the first and second outer coil electrodes 230*a*, 230*b* in a counterclockwise direction. On the contrary, once a current is applied to the first and second inner coil electrodes 220*a*, 220*b*, from the contact electrode plate (refer to 210 of FIG. 2), through the first conductive pins 240*a*, 240*b*, the current flows on the first and second inner coil electrodes 220*a*, 220*b* in a clockwise direction.

Referring to FIG. 6, once a current is applied to the first and second outer coil electrodes 230*a*, 230*b*, from the supplementary electrode plate (not shown, 260 or 260'), through the third conductive pins 270*b*-1, 270*b*-2, the current flows on the first and second outer coil electrodes 230*a*, 230*b* in a clockwise direction. Also, once a current is applied to the first and second inner coil electrodes 220*a*, 220*b*, from the supplementary electrode plate (not shown, 260 or 260'), through the fourth conductive pins 270*c*-1, 270*c*-2, the current flows on the first and second inner coil electrodes 220*a*, 220*b* in a counterclockwise direction.

Referring to FIG. 6, at the center of the electrode for a vacuum interrupter according to the second embodiment, a magnetic flux due to the first and second inner coil electrodes 220*a*, 220*b* and a magnetic flux due to the first and second outer coil electrodes 230*a*, 230*b* eliminates each other at least partially to be weakened to be extinguished. However, magnetic fluxes occurring at a space between the inner coil electrode 220 (first and second inner coil electrodes 220*a*, 220*b*) and the outer coil electrode 230 (first and second outer coil electrodes 230*a*, 230*b*) are formed in the same direction. Accordingly, the magnetic fluxes are added to each other, thereby being implemented as a strong magnetic flux. The strong axial magnetic flux is generated at the periphery of the electrode spacing from the center of the electrode in a radius direction.

In the electrode for a vacuum interrupter according to the second embodiment of the present invention, a strong AMF occurs at the periphery spacing from the center in a radius direction, thereby attracting an arc generated when separating the movable electrode from the fixed electrode. This enables the arc to be distributed. Accordingly, can be solved the conventional problems such as delay of the arc extinguishing time, a lowered function, and damage of the contacts due to concentration of the arc to the center of the electrode.

Referring to FIG. 6, the electrode for a vacuum interrupter according to the second embodiment is configured to comprise one pair of inner coil electrodes implemented as coil conductors, i.e., the first and second inner coil electrodes 220*a*, 220*b*, and one pair of outer coil electrodes implemented as coil conductors, i.e., the first and second outer coil electrodes 230*a*, 230*b*. Accordingly, a current flows to the four coil conductors by being divided. This makes a small amount of current flow to one coil conductor. As a result, in the vacuum interrupter having a narrow gap between contacts of the fixed electrode and the movable electrode, an arc can be rapidly extinguished. Furthermore, damages of the contacts can be minimized, and an interrupting capacity of the vacuum interrupter can be increased.

The electrode for a vacuum interrupter according to the present invention comprises the inner coil electrode on which a current flows in a first rotation direction, and the outer coil electrode on which a current flows in a second rotation direction opposite to the first rotation direction parallel to the current flowing through the inner coil electrode. Accordingly, at the center of the electrode, a magnetic flux due to the inner coil electrode and a magnetic flux due to the outer coil electrode are formed in opposite directions to each other, thus to eliminates each other at least partially to be minimized. However, at a space between the inner and outer coil electrodes, a magnetic flux due to the inner coil electrode and a magnetic flux due to the outer coil electrode are formed in the same direction, thus to have an increased density. As a result, the magnetic flux density of the electrode is not concentrated to the center of the electrode, but is distributed. Accordingly, an arc can be rapidly extinguished by being divided into small parts, and an interrupting capacity of the vacuum interrupter can be increased.

In the electrode for a vacuum interrupter according to the present invention, since a path of a current flowing through the inner coil electrode has a width narrower than that of a current flowing through the outer coil electrode, the inner coil electrode has a larger resistance than the outer coil electrode. And, since the amount of a current flowing through the outer coil electrode is more increased than the amount of a current flowing through the inner coil electrode, a magnetic flux due to the outer coil electrode is larger than a magnetic flux due to the inner coil electrode. Accordingly, a magnetic flux density is not concentrated to the center of the electrode, but is dispersed. As a result, an arc generated when separating the movable electrode from the fixed electrode is dispersed to be rapidly extinguished. And, an interrupting capacity of the vacuum interrupter can be increased.

In the electrode for a vacuum interrupter according to the second embodiment, the inner coil electrodes and the outer coil electrodes are implemented as one pair of coil conductors, respectively. Accordingly, a current flows to the four coil conductors by being divided. This makes a small amount of current flow to one coil conductor. As a result, in the vacuum interrupter having a narrow gap between contacts of the fixed electrode and the movable electrode, an arc can be rapidly extinguished. Furthermore, damages of the contacts can be minimized, and an interrupting capacity of the vacuum interrupter can be increased.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electrode for a vacuum interrupter, comprising:

a contact electrode plate configured to provide contacts;

an inner coil electrode formed of one electric conductor having an open loop shape, and through which a current flows in a first rotation direction;

an outer coil electrode formed of one electric conductor having an open loop shape, concentrically arranged with the inner coil electrode at an outer side of the inner coil electrode in a radius direction, and through which a current flows in a second rotation direction opposite to the first rotation direction parallel to the current flowing to the inner coil electrode;

a first conductive pin made of a conductive material, and configured to provide an electric current path by connecting the contact electrode plate and the inner coil electrode with each other; and a second conductive pin made of a conductive material, and configured to provide an electric current path by connecting the contact electrode plate and the outer coil electrode with each other.

2. The electrode for a vacuum interrupter of claim 1, wherein a path of a current flowing through the outer coil electrode has a width wider than that of a current flowing through the inner coil electrode.

3. The electrode for a vacuum interrupter of claim 1, wherein the inner coil electrode has an electric resistance larger than that of the outer coil electrode.

4. The electrode for a vacuum interrupter of claim 1, further comprising:

a supplementary electrode plate installed below the inner and outer coil electrodes, formed of an electric conductor, and having a plurality of slits formed in a radius direction so as to form an axial magnetic flux and to prevent the occurrence of eddy currents;

a third conductive pin installed between the outer coil electrode and the supplementary electrode plate for electric connection therebetween; and a fourth conductive pin installed between the inner coil electrode and the supplementary electrode plate for electric connection therebetween.

5. The electrode for a vacuum interrupter of claim 4, further comprising a plurality of supporting pins installed between the outer coil electrode and the supplementary electrode plate and between the inner coil electrode and the supplementary electrode plate, and configured to support the inner and outer coil electrodes.

6. The electrode for a vacuum interrupter of claim 1, further comprising:

a supplementary electrode plate installed below the inner and outer coil electrodes, formed of an electric conductor, and having a plurality of slits formed with an inclination angle in a radius direction so as to form an axial magnetic flux and to prevent the occurrence of eddy currents;

a third conductive pin installed between the outer coil electrode and the supplementary electrode plate for electric connection therebetween; and a fourth conductive pin installed between the inner coil electrode and the supplementary electrode plate for electric connection therebetween.

7. The electrode for a vacuum interrupter of claim 6, further comprising a plurality of supporting pins installed between the outer coil electrode and the supplementary electrode plate and between the inner coil electrode and the supplementary electrode plate, and configured to support the inner and outer coil electrodes.

8. The electrode for a vacuum interrupter of claim 6, wherein the inclination angle of the slits in the radius direction is in the range of 30°~60°.

9. An electrode for a vacuum interrupter, comprising:

a contact electrode plate configured to provide contacts;

an inner coil electrode formed of two electric conductors having an open loop shape, and through which a current flows in a first rotation direction;

an outer coil electrode formed of two electric conductors having an open loop shape, concentrically arranged with the inner coil electrode at an outer side of the inner coil electrode in a radius direction, and through which a current flows in a second rotation direction opposite to the first rotation direction parallel to the current flowing to the inner coil electrode;

a first conductive pin configured to provide an electric current path by connecting the contact electrode plate and the inner coil electrode with each other; and a second conductive pin configured to provide an electric current path by connecting the contact electrode plate and the outer coil electrode with each other.

10. The electrode for a vacuum interrupter of claim 9, wherein a path of a current flowing through the outer coil electrode has a width wider than that of a current flowing through the inner coil electrode.

11. The electrode for a vacuum interrupter of claim 9, wherein the inner coil electrode has an electric resistance larger than that of the outer coil electrode.

12. The electrode for a vacuum interrupter of claim 9, further comprising:

a supplementary electrode plate installed below the inner and outer coil electrodes, formed of an electric conductor, and having a plurality of slits formed in a radius direction so as to form an axial magnetic flux and to prevent the occurrence of eddy currents;

a third conductive pin installed between the outer coil electrode and the supplementary electrode plate for electric connection therebetween; and a fourth conductive pin installed between the inner coil electrode and the supplementary electrode plate for electric connection therebetween.

13. The electrode for a vacuum interrupter of claim 12, further comprising a plurality of supporting pins installed between the outer coil electrode and the supplementary electrode plate and between the inner coil electrode and the supplementary electrode plate, and configured to support the inner and outer coil electrodes.

14. The electrode for a vacuum interrupter of claim 9, further comprising:

a supplementary electrode plate installed below the inner and outer coil electrodes, formed of an electric conductor, and having a plurality of slits formed with an inclination angle in a radius direction so as to form an axial magnetic flux and to prevent the occurrence of eddy currents;

a third conductive pin installed between the outer coil electrode and the supplementary electrode plate for electric connection therebetween; and a fourth conductive pin installed between the inner coil electrode and the supplementary electrode plate for electric connection therebetween.

15. The electrode for a vacuum interrupter of claim 14, further comprising a plurality of supporting pins installed between the outer coil electrode and the supplementary electrode plate and between the inner coil electrode and the supplementary electrode plate, and configured to support the inner and outer coil electrodes.

16. The electrode for a vacuum interrupter of claim 14, wherein the inclination angle of the slits in the radius direction is in the range of 30°~60°.

* * * * *